US005865439A

United States Patent [19]

Marcuson, III et al.

[11] Patent Number: 5,865,439

[45] Date of Patent: Feb. 2, 1999

[54] POP-UP TARGET SYSTEM

[75] Inventors: William F. Marcuson, III; Philip G. Malone, both of Vicksburg, Miss.

[73] Assignee: The United States of America Army Corps of Engineers as represented by the Secretary of the Army, Washington, D.C.

[21] Appl. No.: 696,766

[22] Filed: Aug. 14, 1996

[51] Int. Cl.[6] ..... F41S 7/06

[52] U.S. Cl. ..... 273/406; 273/391

[58] Field of Search ..... 273/406, 407, 273/408, 403, 404, 390–392

[56] References Cited

U.S. PATENT DOCUMENTS

| | | | |
|---|---|---|---|
| 741,131 | 10/1903 | Hanson . | |
| 867,034 | 9/1907 | Habersbruner et al. | 273/391 |
| 2,137,976 | 11/1938 | Hopkins . | |
| 2,551,720 | 5/1951 | Bevis | 273/390 |
| 2,587,042 | 2/1952 | Haiselup | 273/391 |
| 2,736,558 | 2/1956 | Ruderman . | |
| 3,034,788 | 5/1962 | Cauble . | |
| 3,586,331 | 6/1971 | Tickell, Jr. . | |
| 3,733,073 | 5/1973 | Gutler . | |
| 4,119,317 | 10/1978 | Ohlund et al. . | |
| 4,232,867 | 11/1980 | Tate, Sr. . | |
| 4,330,129 | 5/1982 | Meredith . | |
| 4,340,370 | 7/1982 | Marshall et al. . | |
| 4,482,156 | 11/1984 | Karlsson . | |
| 4,743,032 | 5/1988 | Summers et al. . | |
| 4,773,653 | 9/1988 | Unverzagt . | |
| 5,240,258 | 8/1993 | Bateman . | |
| 5,350,180 | 9/1994 | Acock . | |
| 5,403,017 | 4/1995 | Doss, III et al. . | |

*Primary Examiner*—Mark S. Graham
*Attorney, Agent, or Firm*—Luther A. Marsh

[57] ABSTRACT

The invention is a pop-up target system wherein a three-dimensional target is raised by a knee-like action. The target may take the form of a head and torso manufactured in two parts, a front half and a back half, which are hinged at the top of the head portion and may incorporate a thick, relatively massive material which will absorb incoming bullets. The bases of the torso halves are each mounted through hinges to two separate four-wheeled platforms or trucks which are constrained by tracks or guide cables to move linearly to move the bases of the torso halves together in an upright position or apart in a flat horizontal position. The linear relative position of the torso halves is controlled by linear moving means attached to the wheeled platforms or trucks such that at the maximum separation between the torso halves, the two halves of the target lays inclined on a brace so as to be out of horizontal alignment, preferably 5 to 10 degrees out of alignment. The slight inclination with the hinge at the head portion of the target elevated above the base assures that any lateral force will fold the two halves at the hinge rather than directing the force across two aligned members attached with a hinge.

20 Claims, 4 Drawing Sheets

POP-UP TARGET SYSTEM

BACKGROUND OF THE INVENTION

1. Field of the Invention

This invention relates to an improved target handling system and, more specifically, to a target system that uses a knee-like action to raise a pop-up style target that consists of a head and torso.

2. Related Art

Currently available pop-up target systems typically handle only lightweight plastic silhouettes. Thus, these targets are unable to absorb bullets. The bullets thus splatter lead upon impact, or pass through the target and are trapped by an earthen berm behind the target. Because the bullets are often made from lead, the lead in the bullets is simply disbursed into the surrounding environment. Accordingly, there is a need in the art to provide targets which are made from material which trap bullets and produce less scattering of metal from bullets.

In addition, because these silhouette targets are two-dimensional (flat), such targets can only be used with a single shooter firing from a specific firing position because the shooter must view the target face-on. In other words, an oblique angle between the target and the shooter does not provide the shooter with a realistic target at which to shoot. In addition, multiple shooters in two positions may not both fire obliquely at the same target, although the use of a cross-fire allows shooters to learn to support each other in combat situations. Accordingly, there is a need in the art to provide the shooter with a target which allows a realistic target at an oblique angle.

The fact that conventional targets are constructed from plastic creates a problem with respect to fire. Tracer ammunition used in training starts grass fires and the plastic targets typically burn or melt and jam the lifting mechanism. Therefore, there is a need in the art to provide a target which is not made from plastic.

Two-dimensional silhouette targets also do not produce realistic shadows when illumination comes from the side of a target. When a shooter is looking down at a target, the movement of a shadow in the ground can be an important part of acquiring a target. Thus, the lack of realistic shadows in a two-dimensional target prevents the shooter from being trained to acquire targets by shadows cast by an enemy emerging from concealment. Accordingly, there is a need in the art to provide the shooter with a three-dimensional target which produces a shadow movement which is comparable to the shadow movement from an opponent moving out of concealment.

Because currently available pop-up target systems typically handle only lightweight plastic silhouettes, most target lifting systems are designed around a rotating arms that cannot lift heavy loads. Because the targets are of moderate weight, motion-sensing devices used in conjunction with the target are prone to error. Specifically, bullets may not be fully absorbed by the target; target motion from wind provides erroneous results; and target motion from spalls or ricochets may provide erroneous results. Accordingly, there is a need in the art to provide a different lifting system to lift heavier targets. This would result in the ability to use more effective instrumentation to determine when hits occur. In addition, a heavier target has improved bullet-stopping ability such that solid hits will transmit more energy to the target and will register more easily on motion-sensing devices. In addition, target motion of a heavier target from wind or from impacts from spalls or ricochets will be different from motions produced by clean hits, thereby assisting in the determination of when hits occur.

Lightweight silhouette targets generally do not have sound or light sources mounted on the target for enhanced realism. One reason why these targets are not so equipped is that the weight of the sound or light sources materially affects the target lifting mechanism. As a result, light or sound equipment is added by using equipment mounted in the pit holding the target mechanism. Specifically, the effect of muzzle flash is produced by using a strobe light directed to illuminate the front of the target and noise is produced by a separate sound-generating device placed near the target. Accordingly, there is a need in the art to provide a target lifting mechanism of such construction to allow mounting of sound or light equipment on a target for enhanced realism without materially affecting the target lift performance.

Thermal gun sights may be used in training with silhouette targets of the prior art. To use the thermal sights, the target itself must be heated. Presently, the target is heated by attaching flexible electrical heater units to the front of the silhouette. However, the heater can be rendered inoperative by incoming fire that breaks the heater resistance wires in the units. Thus, there is a need in the art to provide a more massive target which may be heated when in a non-visible position.

Many target lifting systems generally have the lifting unit at the base of the lifting arm. Accordingly, the target does not cover or protect the lifting mechanism from exposure to gunfire. There is a need in the art to provide a target where the target lifting mechanism is more effectively protected from exposure to gunfire.

SUMMARY OF THE INVENTION

It is in the view of the above needs in the prior art that the present invention was developed. The invention is a pop-up target system wherein a three-dimensional target is raised by a knee-like action. The target may take the form of a head and torso manufactured in two parts, a front half and a back half, which are hinged at the top of the head portion and may be made from a thick, relatively massive material which will absorb incoming bullets. The torso bases are each mounted through hinges to two separate four-wheeled platforms or trucks which are constrained by tracks or guide cables to move linearly to move the bases of the torso halves together in an upright position or apart in a flat nearly-horizontal position. The linear relative position of the torso halves is controlled by linear moving means attached to the wheeled platforms or trucks such that at the maximum separation between the torso halves, the two halves of the target lay inclined on a brace so as to be out of horizontal alignment, preferably 5 to 10 degrees out of alignment. The slight inclination with the hinge at the head portion of the target elevated above the base assures that any lateral force will fold the two halves at the hinge rather than directing the force across two aligned members attached with a hinge.

The linear moving means may comprise a system incorporating a winch-like device that pulls cables attached to the trucks and the frame to pull the bases of the torso halves apart. As the bases are separated, the force also stretches elastic members, springs, attached to the trucks and the frame of the target system such that when the tension on the cables is released, bases of the torso halves will be pulled together to bring the target halves erect rapidly. Alternatively, the linear moving means may comprise hydraulic or pneumatic cylinders such that when pressure is applied to the cylinders, they will move the bases of the torso halves apart using forces applied directly between the trucks or between the trucks and the frame. Either a single double-acting cylinder may be used, or two single-acting cylinders may be used. Alternatively, the linear moving means may comprise a system employing a threaded rod that operates to apply forces to the trucks through threaded fixtures attached to the trucks, or to each separate truck and the frame, when the rod is rotated.

Further features and advantages of the present invention, as well as the structure and operation of various embodiments of the present invention, are described below in detail with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
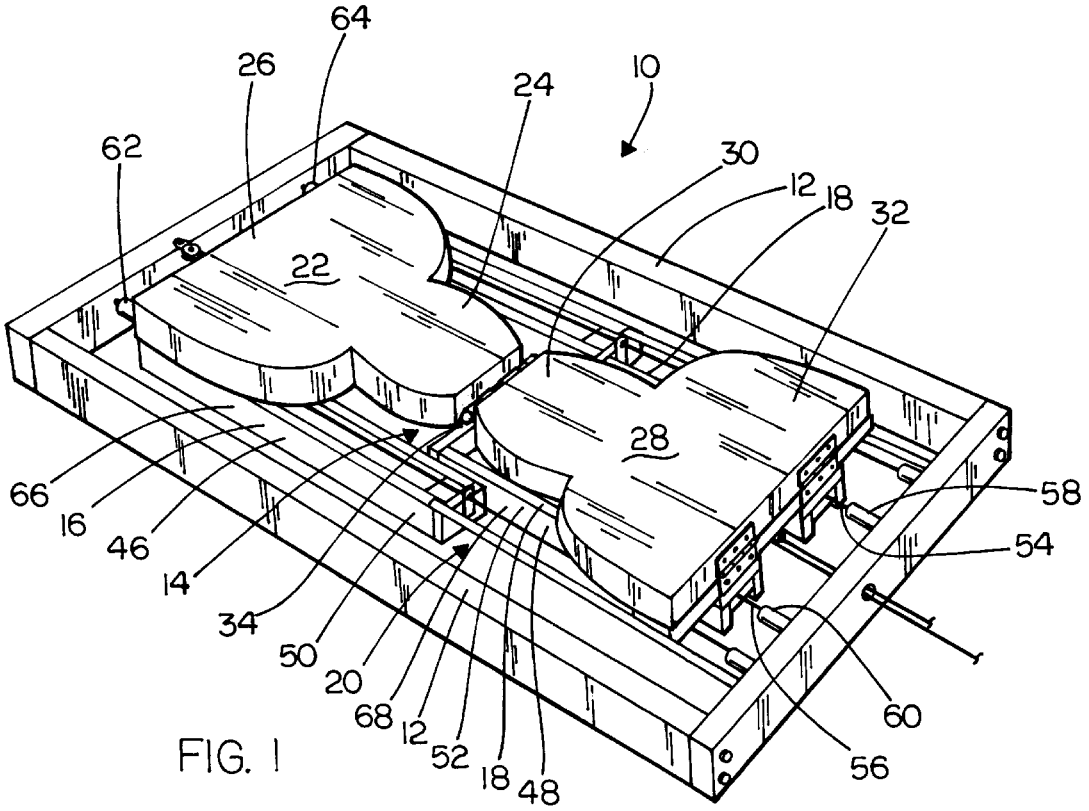
FIG. 1 illustrates a perspective top view of the target system of the present invention.
Figure 2:
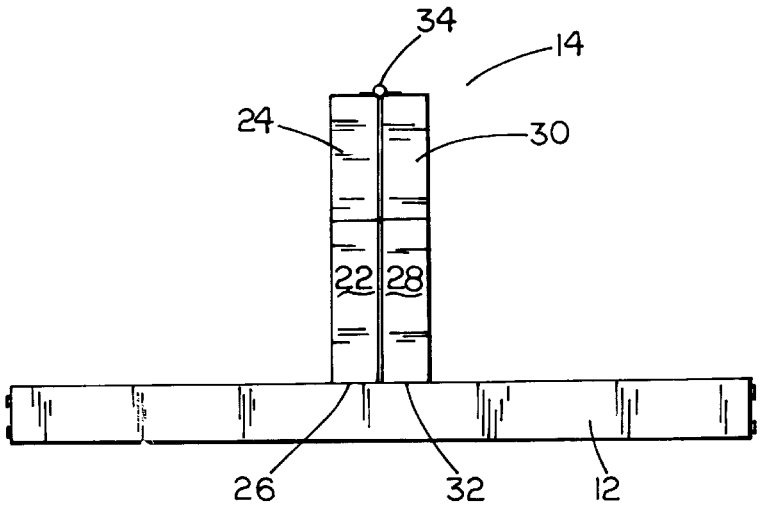
FIG. 2 illustrates a side view of the present invention.
Figure 3A:
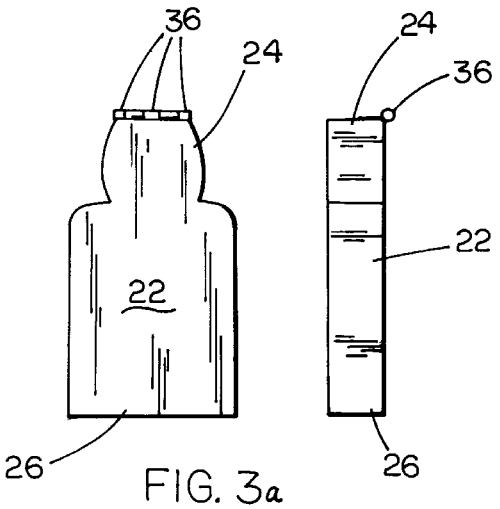
FIG. 3*a* illustrates a detail front view of the target of the present invention.
Figure 3B:
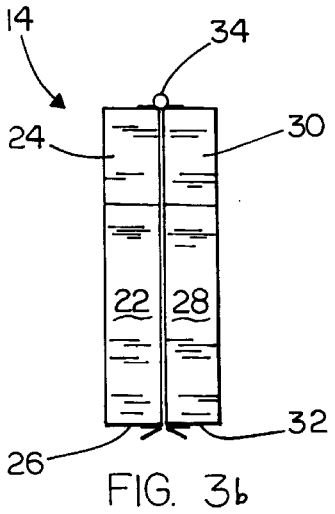
FIG. 3*b* illustrates a detail side view of the target of the present invention.
Figure 3C:
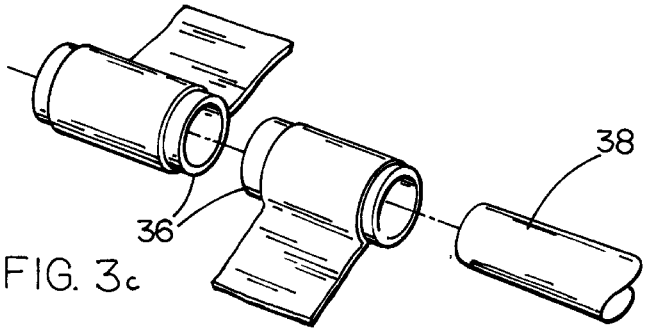
FIG. 3*c* illustrates a detail view of the hinge of the target of the present invention.

Referring to the accompanying drawings in which like reference numbers indicate like elements, FIG. 1 shows the target system of the present invention generally at 10. Target system 10 comprises a frame base 12, a three dimensional target, shown generally at 14, a first movable member 16, a second movable member 18, and means, shown generally at 20, for moving linearly the target 14.

Typical construction of frame 12 would be steel or aluminum tubing welded or bolted together.

Target 14 of the present invention will have a full three-dimensional head and torso. As a result, target 14 can realistically present a variety of views to the shooter providing a more life-like simulation. In addition, target 14 will cast a realistic shadow from any angle of illumination. Target 14 may incorporate a thick, relatively massive material which will absorb incoming bullets such as, but not limited to fiber-reinforced foamed concrete (fiber-reinforced cellular concrete), laminated rubber and metal mesh, molded cellulose fiber, or rubber-fabric laminates. Accordingly, lead scattering and soil contamination will be reduced. If bullet-stopping properties are not needed, target 14 may be a hollow construction made from fiber board, and molded fiberglass or plastic. By having the target, especially a foamed concrete target, over the target moving mechanism, the mechanism can be protected from the heat of a grass fire.

FIGS. 1, 2, 3*a*, and 3*b* illustrate that target 14 comprises front portion 22 having a top portion 24, a base portion 26, and a rear portion 28 having a top portion 30 and a base portion 32. As shown in FIGS. 1, 2, 3*a*, 3*b*, and 3*c*, a hinge 34 hingedly connects top portion 24 of front portion 22 of target 14 to top portion 30 of rear portion 28 of target 14. Hinge 34 may be constructed from sections of fabric-wrapped PVC pipe 36 with a dowel 38 acting as a hinge pin. Dowel 38 may be constructed from wood, plastic, or metal. Alternatively, hinge 34 may be constructed entirely from metal, as is well-known in the art.

First movable member 16 comprises a first wheeled platform 46. Second movable member 18 comprises a second wheeled platform 48. First frame member 50 of first wheeled platform 46 is offset from and parallel to second frame member 52 of second wheeled platform 48 to allow first wheeled platform 46 to intermesh with second wheeled platform 48 in a manner similar to an adjustable plank or pick that is used in scaffolding.

Attached to and through the length of frame 12, and disposed through holes in first wheeled platform 46 and second wheeled platform 48 are first cable 54 and second cable 56. First cable 54 and second cable 56 act as guides which allow first wheeled platform 46 and second wheeled platform 48 to slide linearly in parallel with first cable 54 and second cable 56, but prevents first wheeled platform 46 and second wheeled platform 48 to move in any other direction. Preferably, two additional cables (not shown) may be used as guide wires for additional stability.

Rubber tubing sections 58–64 may be provided adjacent frame 12 and disposed around first cable 54 and second cable 56 to act as shock absorbers and to make the target quieter in operation. Optionally, to prevent excessive wear, metal plates (not shown) may be attached to each of first wheeled platform 46 and second wheeled platform 48, and provided with holes to allow cables 54–56 to pass.

First movable member 16 is pivotally connected to base portion 26 of front portion 22 of target 14. Similarly, second movable member 18 is pivotally connected to base portion 32 of rear portion 28.

Means 20 for linearly moving target 14 may comprise a first means 66 for linearly moving first movable member 16, which member 16 is connected to base portion 26 of front portion 22 of target 14, and a second means 68 for linearly moving second movable member 18, which member 18 is connected to base portion 32 of rear portion 28 of target 14. As discussed above, first movable member 16 and second movable member 18 may be wheeled platforms 46–48, or trucks.

Figure 4:
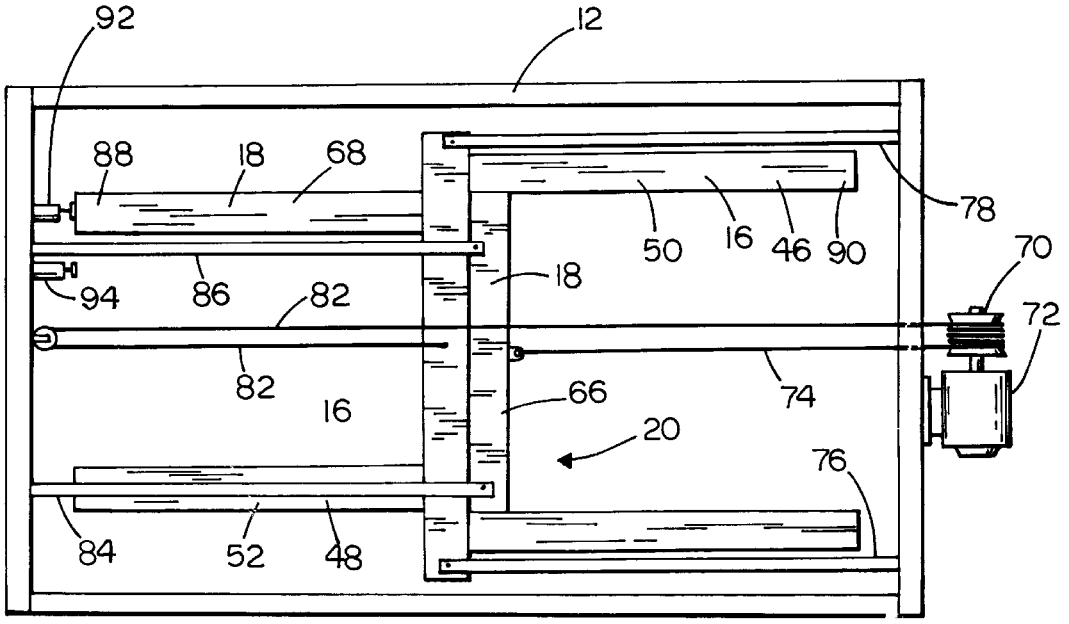
FIG. 4 illustrates the linear moving means of a first embodiment of the present invention.

In a first embodiment of the present invention as shown in FIG. 4, first means 66 for linearly moving first movable member 16 comprises a winch 70, a motor 72 drivingly connected to winch 70, a third cable segment 74 attached to first movable member 16 at one end and to winch 70 at the other end, and a first elastic member 76 and second elastic member 78, each having first and second ends, wherein the first end of each elastic member 76–78 is attached to first movable member 16 and the second end of each elastic member 76–78 is attached to frame 12. Similarly, second means 68 for linearly moving second movable member 18 comprises winch 70, fourth cable segment 82 attached to second movable member 18 at one end and to winch 70 at the other end, and a third elastic member 84 and fourth elastic member 86 each having first and second ends, wherein the first end of third and fourth elastic member 84–86 is attached second movable member 18, and the second end of third and fourth elastic members 84–86 is attached to frame 12. When winch 70 applies tension to third and fourth cable segments 74, 82, the spacing between ends 88–90 of first and second movable members 16–18 decreases, and elastic members 76–78, 84–86 elongate, and base portion 26 and base portion 32 are pulled apart until front portion 22 and rear portion 28 of target 14 separate, but do not assume, a horizontal alignment. Preferably, front portion 22 and rear portion 28 of target 14 will assume an inclination approximately 5–10 degrees out of alignment at maximum extension. When tension is released from first and second cable segments 74–82, elastic members 76–78 and 84–86 contract and pull first and second movable member 16–18 together. Accordingly, because first and second movable members 16–18 are pivotally connected to base portion 26 of front portion 22 and base portion 32 of rear portion 28, front portion 22 and rear portion 28 are also brought together. It is noted that the slight inclination assumed by front portion 22 and rear portion 28 at maximum extension, with hinge 34 at the top or head portion 24, 30 of target 14 elevated above base portion 26, 32 assures that any lateral force exerted by elastic members 76–78, 82–84 will fold target 14 at the hinge 34 rather than direct the force across to aligned members 22, 28 attached with hinge 34.

Elastic members 76–78, 82–84 may be comprised of woven rubber belts, springs, bunge cords, rubber bands, or the like.

The action of motor 72 can be controlled by using first and second travel-limit sensing switches 92–94 to switch off motor 72 when first and second movable members 16–18 are in appropriate positions. Specifically, travel-limit sensing switch 92 indicates when target 14 has approached an upright position. Travel-limit sensing switch 94 indicates when target 14 has approached a near horizontal alignment.

Figure 5:
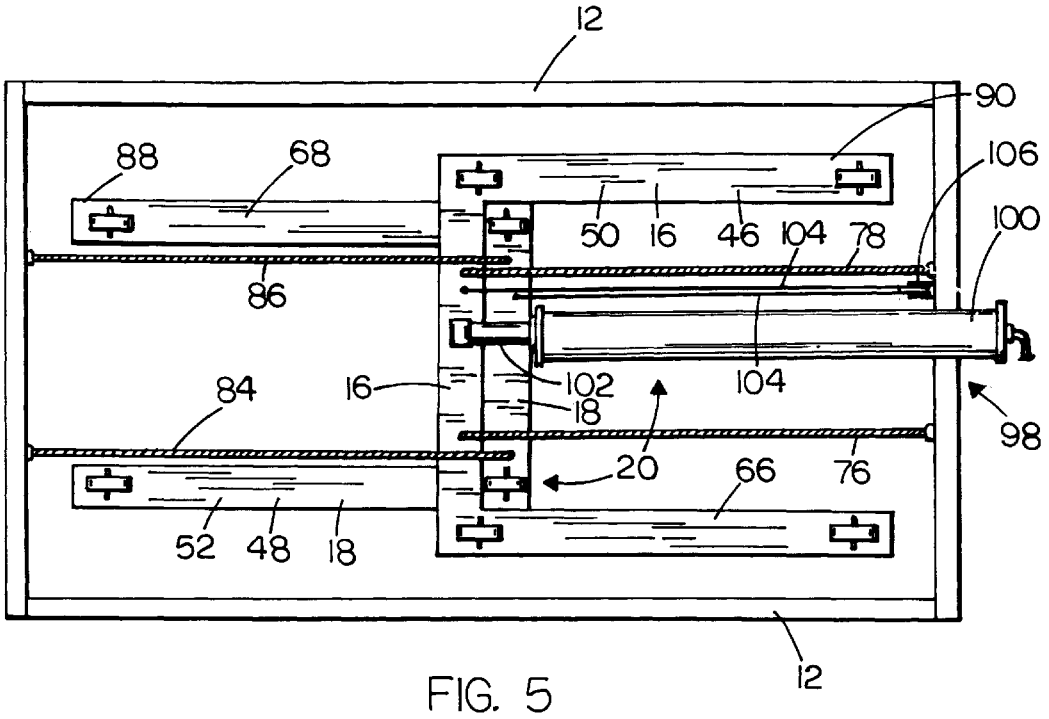
FIG. 5 illustrates the linear moving means of a second embodiment of the present invention.
Figure 6:
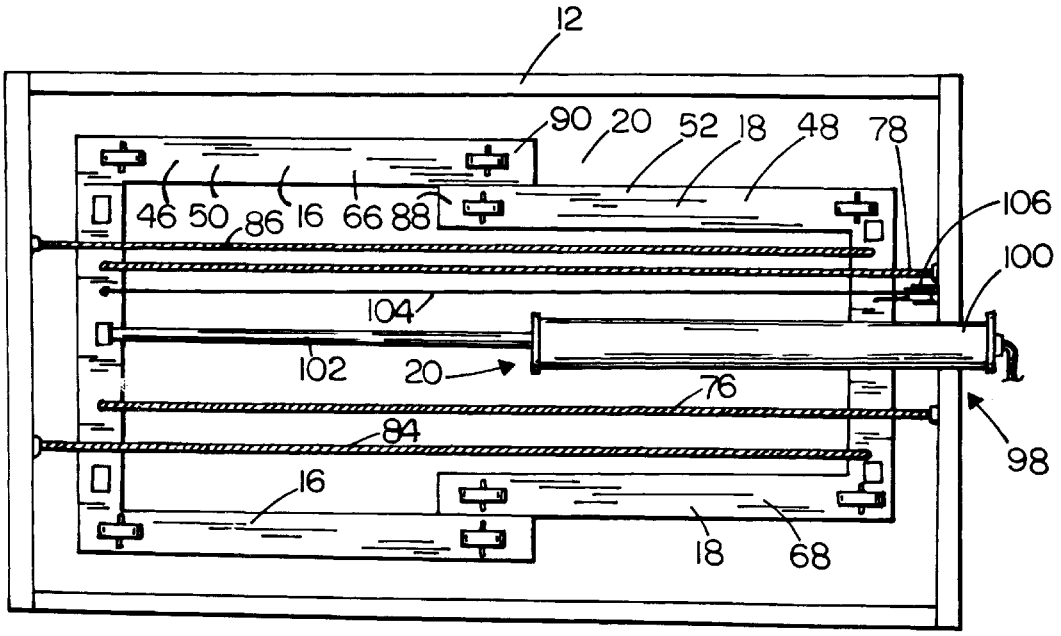
FIG. 6 illustrates the linear moving means of the second embodiment of the present invention with the target in the down position.
Figure 7:
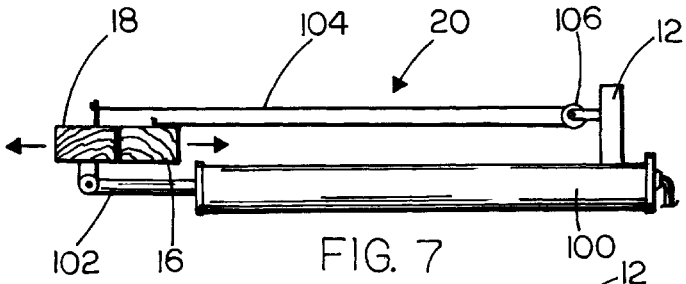
FIG. 7 illustrates a detail view of the pulley system of the present invention.

In a second embodiment of the present invention as shown in FIGS. 5, 6, and 7, means 20 for linearly moving first movable member 16 and second movable member 18 comprises single-action cylinder system shown generally at 98 which comprises a cylinder 100 attached to frame 12, a piston rod 102 attached at one end to and within cylinder 100 and attached to first movable member 16 at the other end, fifth cable segment 104 attached to first movable member 16 on one end and second movable member 18 on the other end, and a first elastic member 76 and second elastic member 78, each having first and second ends, wherein the first end of each elastic member 76–78 is attached to first movable member 16 and the second end of each elastic member 76–78 is attached to frame 12.

Accordingly, in use, as shown in FIGS. 5–7, target 14 which is attached to first and second movable members 16–18, is in the upright position in FIG. 5 and cylinder 100 is non-pressurized. When fluid pressure is applied within cylinder 100, such pressure forces piston rod 102 to move linearly outward from cylinder 100. Simultaneously, first movable member 16 is forced linearly away from second movable member 18, which applies tension upon fifth cable segment 104 to force second movable member 18 to move away from first movable member 16. As this relative movement is experienced, tension is applied on first, second, third, and fourth elastic members 76–78, 84–86, resulting in the configuration shown in FIG. 6. As a result, target 14, which is not shown for clarity, has front portion 22 assume a slight inclination angle relative to rear portion 28 of target 14, with hinge 34 assuming a higher elevation than the bottom of either base portion 26 or base portion 32. When pressure within cylinder 100 is released, the elastic members 76–78, 84–86 which are in a high degree of tension, are free to relieve tension by contracting and thereby forcing first and second movable members 16–18 toward each other, and thereby snap target 14 into an upright position.

Cylinder 100 and piston rod 102 may be of hydraulic or pneumatic origin.

Figure 8:
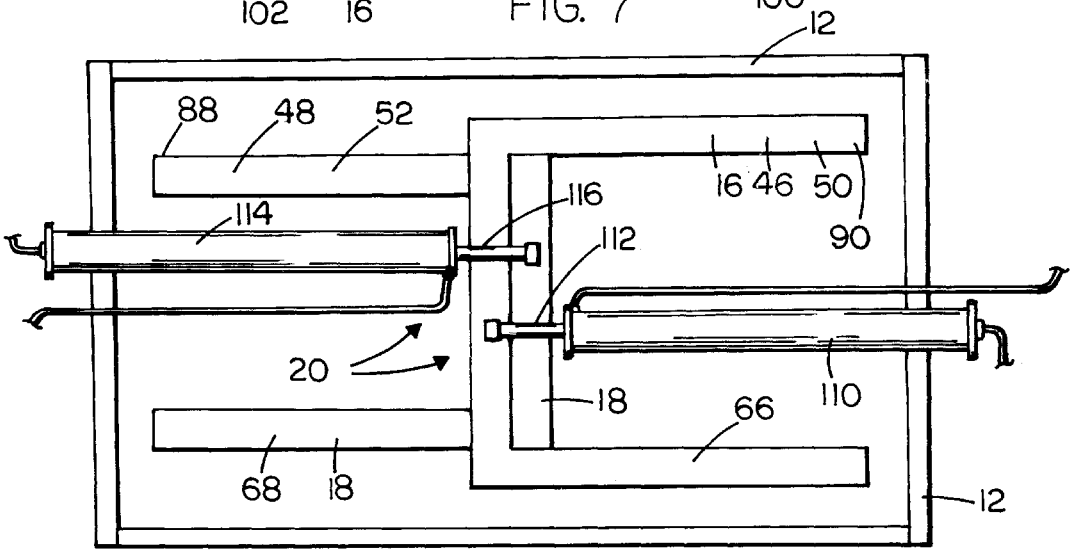
FIG. 8 illustrates the linear moving means of a third embodiment of the present invention.

In a third embodiment of the present invention as shown in FIG. 8, first means 66 for linearly moving first movable member 16 comprises a third cylinder 110 attached to frame 12, and third piston rod 112 attached at one end to a piston in cylinder 110 and to first movable member 16 at the other end. Similarly, second means 68 for linearly moving second movable member 18 comprises a fourth cylinder 114 attached to frame 12, and a fourth piston rod 116 attached at one end to a piston in fourth cylinder 114 and to second movable member 18 at the other end. In this embodiment, no elastic members are utilized.

Figure 9:
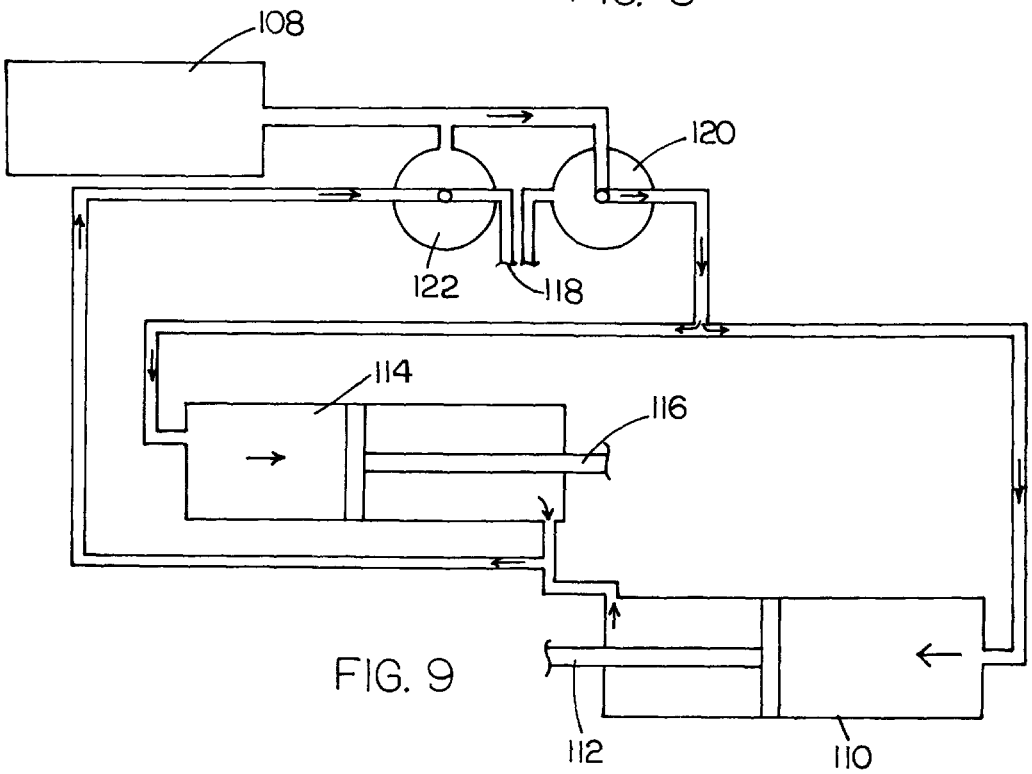
FIG. 9 illustrates a schematic of the control system of the linear moving means of the third embodiment of the present invention.

In use, as more clearly seen in FIGS. 8 and 9, third cylinder 110 and fourth cylinder 114 are commonly pressurized and depressurized to guarantee simultaneous, equidistant, linear movement between first movable member 16 and second movable member 18. As pressure is applied from pressure source 108, which may be a pressure-regulated compressed air source, to cylinders 110, 114, piston rods 112 and 116 are forced away from their respective cylinders, thereby moving movable members 16–18 and lowering front portion 22 and rear portion 28 such that target 14 assumes a hidden or down position. When the pressure acting within cylinders 110 and 114 are reversed, pistons rods 112–116 are forced laterally into the cylinders 110, 114, thereby raising target 14 in the manner described in the previous embodiments with the excess fluid pressure vented at vent 118 through ganged valves 120–122.

In all of the foregoing embodiments, the trigger for actuating the means 20 for linearly moving target 14 can be an electric solenoid or pneumatic or hydraulic actuator. In addition, the new target can be heated by a heater (not shown) mounted on the frame below the target when the system is in its flattened position and will permit the target to present a thermal signature without using a target-mounted heater.

The various means 10, 66, 68 for linearly moving target 14 as described in the various embodiments are critical to the present invention because the massive nature of target 14 specifically precludes the lightweight plastic silhouette target moving means of prior art from the ability to sustain such loading.

Target 14 may also be equipped with muzzle flash simulation which can be a strobe light with a fiber-optic link that terminates in a position appropriate for the end of a rifle.

In view of the foregoing, it will be seen that the several advantages of the invention are achieved and other advantages are attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. For example, in FIG. 5, piston rod 102 may be instead attached to second movable member 18 with cylinder 100 attached to frame 12 on the same side as that occupied by second movable member 18. Another modification falling within the scope of the present invention involves the use of wheel guides or tracks (not shown for drawing clarity) for constraining the movement of first and second moveable members 16–18 to a linear path. In addition, another modification of the linear moving means 20 comprises a threaded rod, a first threaded fixture threadingly connected to said threaded rod, and connected to first moveable member 16 a second threaded fixture threadingly connected to said threaded rod, and connected to said second moveable member 18 and means for rotating said threaded rod, said means comprising a motor. Thus, the breadth and scope of the present invention should not be limited by any of the above-described exemplary embodiments, but should be defined only in accordance with the following claims appended hereto and their equivalents.

What is claimed is:

1. A pop-up target system comprising:

a frame base;

a frame disposed on said frame base;

a three-dimensional target having a front portion and a rear portion;

said front portion having a top portion and a base portion;

said rear portion having a top portion and a base portion;

said top portion of said front portion of said target being hingedly connected to said top portion of said rear portion of said target;

a first moveable member disposed on said frame base, and within said frame;

a second moveable member disposed on said frame base, and within said frame;

said base portion of said front portion of said target being pivotally connected to said first moveable member;

said base portion of said rear portion of said target being pivotally connected to said second moveable member; and means for linearly moving said first moveable member and said second moveable member wherein when said first moveable member moves in one direction relative to said second moveable member, said front and rear portions of said target rotate upward, and when said first moveable member moves in an opposite direction relative to said second moveable member, said front and rear portion of said target rotate downward.

2. The pop-up target system according to claim 1 wherein said first moveable member is a wheeled moveable platform.

3. The pop-up target system according to claim 1 wherein said second moveable member is a wheeled moveable platform.

4. The pop-up target system according to claim 1 wherein said means for linearly moving said first moveable member and said second moveable member comprises a hydraulic cylinder and a piston.

5. The pop-up target system according to claim 1 wherein said means for linearly moving said first moveable member and said second moveable member comprises a pneumatic cylinder and a piston.

6. A pop-up target system comprising:

a frame base;

a frame disposed on said frame base;

a three-dimensional target having a front portion and a rear portion;

said front portion having a top portion and a base portion;

said rear portion having a top portion and a base portion;

said top portion of said front portion of said target being hingedly connected to said top portion of said rear portion of said target;

a first moveable member disposed on said frame base, and within said frame;

a second moveable member disposed on said frame base, and within said frame;

said base portion of said front portion of said target being pivotally connected to said first moveable member;

said base portion of said rear portion of said target being pivotally connected to said second moveable member;

a first means for linearly moving said first moveable member; and a second means for linearly moving said second moveable member, wherein when said first and second means linearly move said first and second moveable members in opposite directions to a first position, said base portions of said front and rear portions are pivotally forced upward to form said three-dimensional target, and when said first and second means linearly move said first and second moveable members in the reverse opposite direction to a second position, said base portions of said front and rear portions are pivotally forced downward and said target is lowered.

7. The pop-up target system according to claim 6 wherein said first moveable member is a truck.

8. The pop-up target system according to claim 6 wherein said second moveable member is a truck.

9. The pop-up target system according to claim 6 wherein said first moveable member is a wheeled moveable platform.

10. The pop-up target system according to claim 6 wherein said second moveable member is a wheeled moveable platform.

11. The pop-up target system according to claim 6 wherein said first means for linearly moving said first moveable member and said second means for linearly moving said second moveable member comprises:

a winch;

a first cable segment attached to said first moveable member at one end and attached to said winch at the other end;

a second cable segment attached to said second moveable member at one end and attached to said winch at the other end;

an elastic member having first and second ends, wherein said first end of said elastic member is attached to said first moveable member and said second end of said elastic member is attached to said frame;

wherein when said winch applies tension to said first and second cable segments, the spacing between said first and second moveable members increases and said elastic member elongates; and wherein when the tension is released from said first and second cable segments, said elastic member pulls said first and second moveable members together and said front portion of said target and said rear portion of said target are brought together.

12. The pop-up target system according to claim 6 wherein said first means for moving linearly said first moveable member and said second means for moving linearly said second moveable member comprises hydraulic cylinders.

13. The pop-up target system according to claim 6 wherein said first means for moving linearly said first moveable member and said second means for moving linearly said second moveable member comprises pneumatic cylinders.

14. The pop-up target system according to claim 6 wherein said first means for moving linearly said first moveable member and said second means for moving linearly said second moveable member comprises:

a threaded rod;

a first threaded fixture threadingly connected to said threaded rod, and connected to said first moveable member;

a second threaded fixture threadingly connected to said threaded rod, and connected to said second moveable member; and means for rotating said threaded rod.

15. The pop-up target system according to claim 14 wherein said means for rotating said threaded rod comprises a motor.

16. The pop-up target system according to claim 6 wherein said three-dimensional target comprises rubber-fabric laminates.

17. The pop-up target system according to claim 6 wherein said three-dimensional target comprises fiber-reinforced cellular concrete.

18. The pop-up target system according to claim 6 wherein said three-dimensional target comprises molded cellulose fiber.

19. The pop-up target system according to claim 6 wherein said three-dimensional target comprises molded plastic.

20. The pop-up target system according to claim 6 wherein said three-dimensional target comprises molded fiberglass.

* * * * *